US008997479B2

(12) United States Patent
Wen et al.

(10) Patent No.: US 8,997,479 B2
(45) Date of Patent: Apr. 7, 2015

(54) HYDRAULIC CONTROL SYSTEM HAVING ENERGY RECOVERY

(75) Inventors: Gang Victor Wen, Dunlap, IL (US); Jiao Zhang, Naperville, IL (US); Pengfei Ma, Naperville, IL (US); Tonglin Shang, Bolingbrook, IL (US)

(73) Assignee: Caterpillar Inc., Peoria, IL (US)

( * ) Notice: Subject to any disclaimer, the term of this patent is extended or adjusted under 35 U.S.C. 154(b) by 532 days.

(21) Appl. No.: 13/458,701

(22) Filed: Apr. 27, 2012

(65) Prior Publication Data

US 2013/0283777 A1 Oct. 31, 2013

(51) Int. Cl.

| | |
|---|---|
| ***F15B 11/02*** | (2006.01) |
| ***E02F 9/22*** | (2006.01) |
| ***F15B 11/024*** | (2006.01) |

(52) U.S. Cl.

CPC ..... *E02F 9/2217* (2013.01); *E02F 9/2296* (2013.01); *F15B 11/024* (2013.01); *F15B 2211/3058* (2013.01); *F15B 2211/411* (2013.01); *F15B 2211/41527* (2013.01); *F15B 2211/428* (2013.01); *F15B 2211/50518* (2013.01); *F15B 2211/5159* (2013.01); *F15B 2211/6313* (2013.01); *F15B 2211/6346* (2013.01); *F15B 2211/665* (2013.01); *F15B 2211/7053* (2013.01); *F15B 2211/761* (2013.01)

(58) Field of Classification Search

CPC ..... F15B 11/024; F15B 13/021
USPC ..... 60/461; 91/420, 436, 437
See application file for complete search history.

(56) References Cited

U.S. PATENT DOCUMENTS

| | | | | |
|---|---|---|---|---|
| 4,216,702 | A * | 8/1980 | Brundidge et al. | 91/436 |
| 5,826,486 | A * | 10/1998 | Shimada | 91/436 |
| 6,732,512 | B2 | 5/2004 | Pfaff et al. | |
| 6,880,332 | B2 | 4/2005 | Pfaff et al. | |
| 6,951,102 | B2 | 10/2005 | Tabor | |
| 7,373,869 | B2 | 5/2008 | Pfaff et al. | |
| 7,448,309 | B2 * | 11/2008 | Bitter | 91/436 |
| 7,451,685 | B2 | 11/2008 | Tabor | |
| 8,752,372 | B2 * | 6/2014 | Ramler et al. | 91/437 |
| 2003/0159577 | A1 | 8/2003 | Pfaff et al. | |
| 2004/0055453 | A1 | 3/2004 | Tabor | |
| 2006/0090462 | A1 | 5/2006 | Yoshino | |

FOREIGN PATENT DOCUMENTS

| | | |
|---|---|---|
| GB | 2437615 | 10/2007 |

* cited by examiner

*Primary Examiner* — Thomas E Lazo
(74) *Attorney, Agent, or Firm* — Finnegan, Henderson, Farabow, Garrett & Dunner, LLP

(57) ABSTRACT

A hydraulic control system is disclosed for use with a machine. The hydraulic control system may have a pump, a tank, and an actuator. The hydraulic control system may also have at least a first valve configured to control fluid flow between the pump, the tank, a first chamber of the actuator, and a second chamber of the actuator; a second valve fluidly disposed between the second chamber and the tank; and a third valve fluidly disposed between the first and second chambers. The hydraulic control system may further have a controller configured to selectively cause the second valve to block fluid flow from the second chamber of the actuator to the tank, and to selectively cause the third valve to fluidly communicate the first and second chambers of the actuator when the second valve blocks fluid flow from the second chamber of the actuator to the tank.

20 Claims, 2 Drawing Sheets

HYDRAULIC CONTROL SYSTEM HAVING ENERGY RECOVERY

TECHNICAL FIELD

The present disclosure relates generally to a hydraulic control system and, more particularly, to a hydraulic control system having energy recovery.

BACKGROUND

Machines such as dozers, loaders, excavators, motor graders, and other types of heavy equipment use one or more hydraulic actuators to move a work tool. These actuators are fluidly connected to a pump on the machine that provides pressurized fluid to chambers within the actuators. As the pressurized fluid moves into or through the chambers, the pressure of the fluid acts on hydraulic surfaces of the chambers to affect movement of the actuator and the connected work tool. When the pressurized fluid is drained from the chambers, it is returned to a low-pressure sump on the machine.

One problem associated with this type of hydraulic arrangement involves efficiency. In particular, the fluid draining from the actuator chambers to the sump often has a pressure greater than the pressure of the fluid already within the sump. As a result, the higher pressure fluid draining into the sump still contains some energy that is wasted upon entering the low-pressure sump. This wasted energy reduces the efficiency of the hydraulic system.

One method of improving the efficiency of a hydraulic system is described in U.S. Patent Publication No. 2003/0159577 of Pfaff that published on Aug. 28, 2003 (the '577 publication). In particular, the '577 publication describes a hydraulic system having five different electro-hydraulic valves connected between a variable displacement pump, a tank, and a tandem pair of boom actuators. A first of the valves controls pump flow to rod-ends of the boom actuators. A second of the valves controls flow from the rod-ends of the boom actuators to the tank. A third of the valves controls pump and tank connections with fourth and fifth valves. The fourth and fifth valves control independent flows into and out of head-ends of the boom actuator. The different valves of the hydraulic system are selectively controlled to produce an unpowered regenerative retract operation and a powered regenerative extend operation. During these operations, fluid is recycled between the head- and rod-ends of the boom actuators to reduce a load on the pump, thereby also reducing an amount of high-pressure fluid that is wasted during actuation and increasing an efficiency of the system.

Although the system of the '577 publication may have improved efficiency compared to a conventional hydraulic system, it may lack applicability. In particular, it may not be functional with a configuration having pilot-operated control valves or valves that control common functions associated with both head- and rod-ends of an actuator. In addition, the system of the '577 publication may not consider critical performance factors affecting regeneration during valve control.

The disclosed hydraulic control system is directed to overcoming one or more of the problems set forth above and/or other problems known in the art.

SUMMARY

One aspect of the present disclosure is directed to a hydraulic control system for a machine. The hydraulic control system may include a pump, a tank, and an actuator having a first chamber and a second chamber. The hydraulic control system may also include at least a first valve configured to control fluid flow between the pump, the tank, the first chamber of the actuator, and the second chamber of the actuator; a second valve fluidly disposed between the second chamber of the actuator and the tank; and a third valve fluidly disposed between the first and second chambers of the actuator. The hydraulic control system may further include a controller in communication with the second and third valves. The controller may be configured to selectively cause the second valve to block fluid flow from the second chamber of the actuator to the tank, and to selectively cause the third valve to fluidly communicate the first and second chambers of the actuator when the second valve blocks fluid flow from the second chamber of the actuator to the tank.

Another aspect of the present disclosure is directed to a method of recovering energy for a machine. The method may include pressurizing fluid with a pump, and selectively moving at least a first control valve to direct pressurized fluid from the pump to first or second chambers of a first actuator and from the second or first chambers of the first actuator to a tank to move the first actuator. The method may also include selectively blocking fluid flow from the second chamber of the first actuator to the tank, and selectively fluidly communicating the first chamber of the first actuator with the second chamber of the first actuator when the fluid flow from the second chamber of the first actuator to the tank is blocked.

Yet another aspect of the present disclosure is directed to another hydraulic control system for a machine. This hydraulic control system may include a pump; a tank; and an actuator having a first chamber and a second chamber, and a piston separating the first and second chambers. The piston may be movable in an extending direction and in a retracting direction. The hydraulic control system may also include a first valve configured to control fluid flow between the pump, the tank, the first chamber of the actuator, and the second chamber of the actuator; a second valve fluidly disposed between the second chamber of the actuator and each of the first valve and the first chamber; and a third valve fluidly disposed between the first chamber and the second valve. When the piston is moving in the extending direction, the second valve is configured to selectively block fluid flow from the second chamber to the tank and the first valve is configured to direct pressurized fluid from the pump to combine with pressurized fluid from the second chamber entering the first chamber.

DETAILED DESCRIPTION

Figure 1:
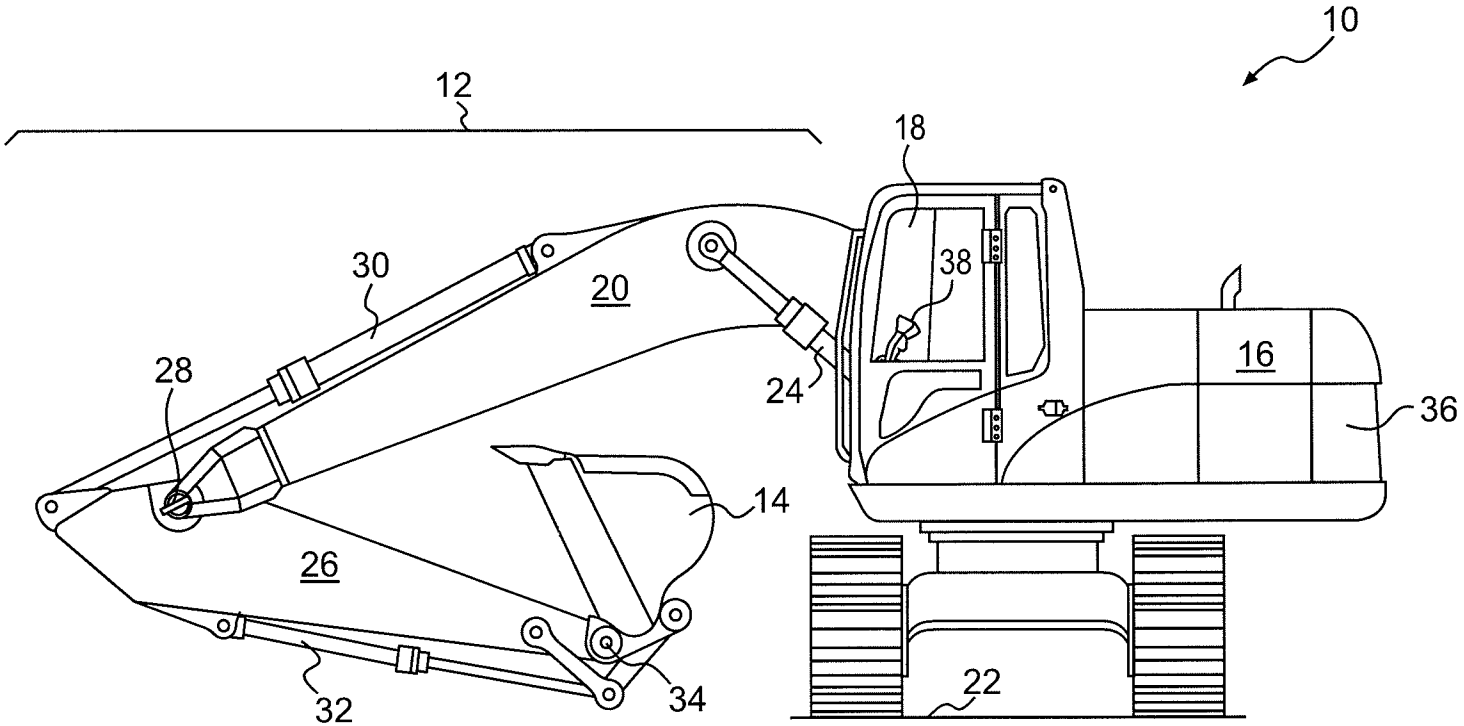
FIG. 1 is a diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be an earth moving machine such as an excavator (shown in FIG. 1), a dozer, a loader, a backhoe, a motor grader, a dump truck, or another earth moving machine. Machine 10 may include an implement system 12 configured to move a work tool 14, a power source 16 that provides power to implement system 12, and an operator cabin 18 that provides for manual control of implement system 12 and power source 16.

Implement system 12 may include a linkage structure acted on by fluid actuators to move work tool 14. Specifically, implement system 12 may include a boom 20 that is vertically pivotal about a horizontal axis (not shown) relative to a work surface 22 by a pair of adjacent, double-acting, hydraulic cylinders 24 (only one shown in FIG. 1). Implement system 12 may also include a stick 26 that is vertically pivotal about a horizontal axis 28 by a single, double-acting, hydraulic cylinder 30. Implement system 12 may further include a single, double-acting, hydraulic cylinder 32 that is operatively connected between stick 26 and work tool 14 to pivot work tool 14 vertically about a horizontal pivot axis 34. Boom 20 may be pivotally connected to a frame 36 of machine 10. Stick 26 may pivotally connect boom 20 to work tool 14 by way of axis 28 and 34.

Each of hydraulic cylinders 24, 30, and 32 may be linear actuators that include a tube and a piston assembly arranged to form two separated pressure chambers (e.g., a head-end chamber and a rod-end chamber). The pressure chambers may be selectively supplied with pressurized fluid and drained of the pressurized fluid to cause the piston assembly to displace within the tube, thereby changing an effective length of hydraulic cylinders 24, 30, and 32. The flow rate of fluid into and out of the pressure chambers may relate to a velocity of hydraulic cylinders 24, 30, and 32, while a pressure differential between the two pressure chambers may relate to a force imparted by hydraulic cylinders 24, 30, and 32 on the associated linkage.

The expansion and retraction of hydraulic cylinders 24, 30, and 32 may function to assist in moving work tool 14. For example, an expansion of hydraulic cylinder 24 may result in a lifting of boom 20 (and work tool 14), while a retraction of hydraulic cylinder 24 may result in a lowering of boom 20. Similarly, expanding and retracting movements of hydraulic cylinders 30 and 32, for example during a digging operation, may curl or uncurl work tool 14 relative to boom 20.

Numerous different work tools 14 may be attachable to a single machine 10 and operator controllable. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to frame 36 of machine 10, work tool 14 may alternatively or additionally rotate, slide, swing, lift, or move in any other manner known in the art.

Power source 16 may embody an engine such as, for example, a diesel engine, a gasoline engine, a gaseous fuel-powered engine, or any other type of combustion engine known in the art. It is contemplated that power source 16 may alternatively embody a non-combustion source of power such as a fuel cell, a power storage device, or another source known in the art. Power source 16 may produce a mechanical or electrical power output that may then be converted to hydraulic power for moving hydraulic cylinders 24, 30, and 32.

Operator cabin 18 may embody a generally enclosed station having devices that receive manual input indicative of desired machine and tool maneuvering. Specifically, operator cabin 18 may include one or more interface devices 38 located proximate an operator seat (not shown). Interface devices 38 may initiate movement and/or activate features of machine 10 by producing signals that are indicative of a desired machine function. As shown in the exemplary embodiment of FIG. 2, interface devices 38 may include a first interface device 38*a* associated with desired movements of boom 20, and a second interface device 38*b* associated with desired movements of stick 26 and/or work tool 14. As an operator manipulates interface devices 38 (i.e., displaces interface devices 38 away from a neutral position), the operator may expect and affect a corresponding operation of hydraulic cylinders 24, 30, 32 (e.g., an expanding or retracting operation). It is contemplated that interface devices 38 may embody any conventional devices known in the art, for example joysticks, levers, foot pedals, switches, knobs, wheels, etc.

Figure 2:
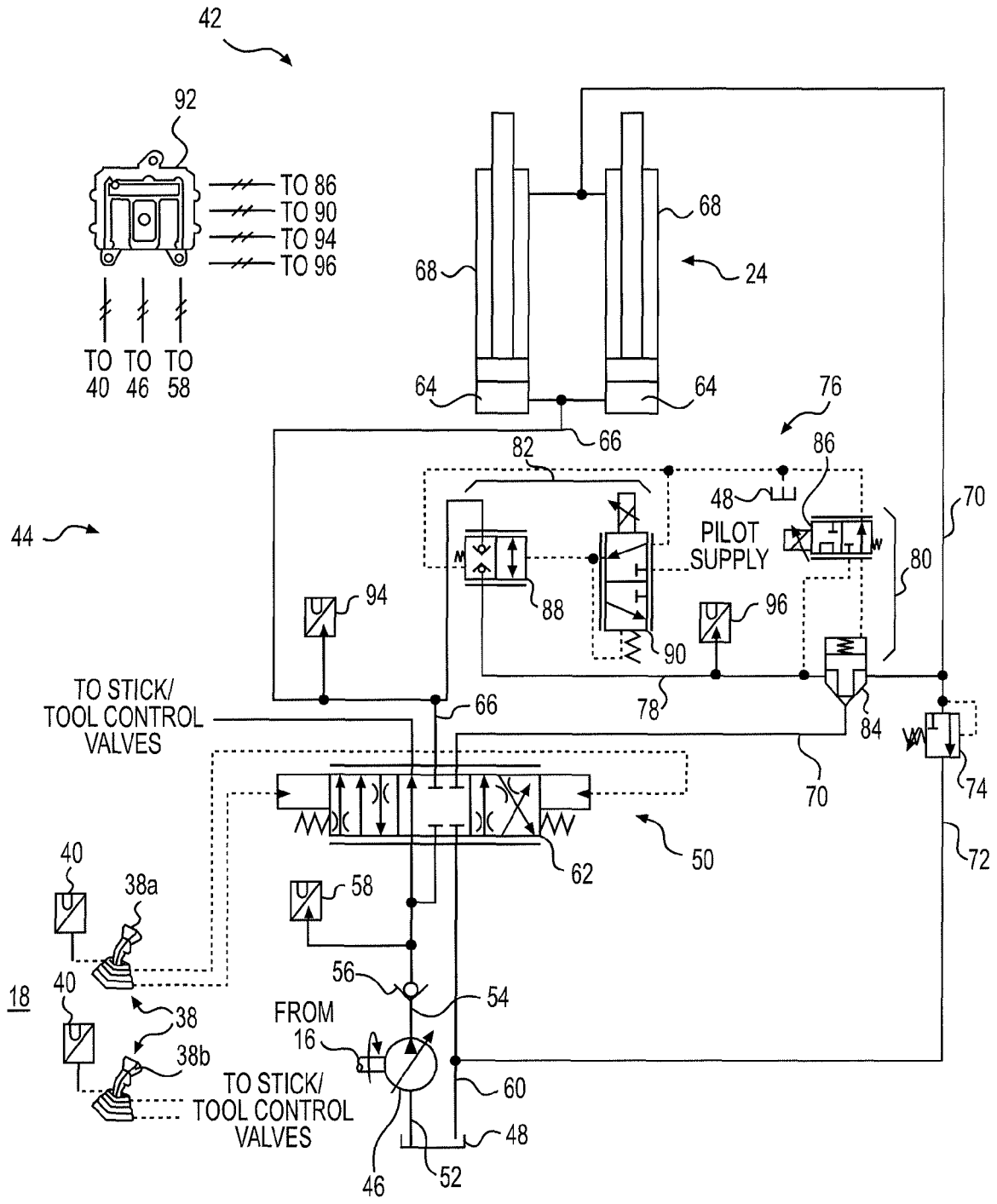
FIG. 2 is a schematic illustration of an exemplary disclosed hydraulic control system that may be used with the machine of FIG. 1.

As illustrated in FIG. 2, a sensor 40, such as a switch or potentiometer, may be provided in association with one or more of interface devices 38 to sense the displacement positions thereof and produce corresponding signals responsive to the displaced positions. The displacement signals from sensors 40, as will be described in more detail below, may be used to control operations of implement system 12.

Machine 10 may include a hydraulic control system 42 having a plurality of fluid components that cooperate to move work tool 14 (referring to FIG. 1). In particular, hydraulic control system 42 may include a generally open circuit 44 configured to receive pressurized fluid from a pump 46 and return waste fluid to a tank 48. Circuit 44 may include, among other things, a boom control valve 50 disposed between hydraulic cylinders 24, pump 46, and tank 28. Although not shown, it is contemplated that circuit 44 may additionally include a stick control valve, a tool control valve, and an auxiliary control valve, if desired.

Pump 46 may be configured to draw fluid from tank 48 via a low-pressure passage 52, pressurize the fluid to a predetermined level, and discharge the pressurized fluid to boom control valve 50 via a discharge passage 54. In the disclosed exemplary embodiment, pump 46 may be a piston-type, variable-displacement pump. It is contemplated, however, that pump 46 may alternatively be a rotary type of pump and/or have a fixed displacement, if desired. Pump 46 may be drivably connected to power source 16 of machine 10 by, for example, a countershaft (not shown), a belt (not shown), an electrical circuit (not shown), or in any other suitable manner. A check valve 56 may be disposed within discharge passage 54 to provide for a unidirectional flow of fluid through pump 46.

A sensor 58, such as a pressure or flow-rate sensor, may be provided in association with discharge passage 54 to sense the performance of pump 46 and produce a corresponding signal responsive to the performance. The performance signal from sensor 58, as will be described in more detail below, may be used to control operations of implement system 12.

Tank 48 may constitute a reservoir configured to hold a supply of low-pressure fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 48. It is contemplated that hydraulic control system 42 may be connected to multiple separate fluid tanks or to a single tank, as desired. In the disclosed embodiment, tank 48 may be fluidly connected to boom control valve 50 via a return passage 60.

Boom control valve 50 may include an element 62 that is movable to control the motion of hydraulic cylinders 24 associated with lifting and lowering of boom 20. In the disclosed embodiment, element 62 is a pilot-operated spool element that is movable to any position between three distinct positions based on direct operator input received via interface device 38*a*. When element 62 is in its first position (shown in FIG. 2), fluid flow to and from hydraulic cylinders 24 may be inhibited by element 62. In this same position, however, pressurized fluid from pump 46 may be allowed to pass through element 62 to other control valves (e.g. to stick and/or bucket control valves) of hydraulic control system 42 in a substantially unrestricted manner. When element 62 is in its second position (the left-most position shown in FIG. 2), pressurized fluid from pump 46 may be allowed to pass to head-end chambers 64 of hydraulic cylinders 24 via a head-end passage 66 and to the other control valves of hydraulic control system 42. In this same position, fluid from rod-end chambers 68 of hydraulic cylinders 24 may be allowed to drain to tank 48 via a rod-end passage 70. By simultaneously supplying pressurized fluid to head-end chambers 64 and draining rod-end chambers 68 of fluid, hydraulic cylinders 24 may be caused to extend, thereby lifting boom 20. When element 62 is in its third position (the right-most position shown in FIG. 2), pressurized fluid from pump 46 may be allowed to pass to rod-end chambers 68 via rod-end passage 70 and to the other control valves of hydraulic control system 42. In this same position, fluid from head-end chambers 64 may be allowed to drain to tank 48 via head-end passage 66. By simultaneously supplying pressurized fluid to rod-end chambers 68 and draining head-end chambers 64 of fluid, hydraulic cylinders 24 may be caused to retract, thereby lowering boom 20. Element 62 may be spring-biased toward the first position and selectively moved to either of the second and third positions by hydraulic pilot signals generated via manual displacement of interface device 38*a*.

In the disclosed embodiment, hydraulic cylinders 24 may have flow-priority over hydraulic cylinders 30 and 32. In particular, the flow of pressurized fluid from pump 46 through boom control valve 50 (i.e., through element 62 when element 62 is in the $2^{nd}$ or $3^{rd}$ positions) to the other control valves associated with hydraulic cylinders 30 and 32 may be restricted, while the flow of pressurized fluid through control valve 50 to hydraulic cylinders 24 may be substantially unrestricted. In this manner, hydraulic cylinders 24 may be allowed to consume a greater portion of the output of pump 46, even if this consumption would result in a slower movement of hydraulic cylinders 30 and 32. The fluid draining through element 62 may also be restricted to help maintain a desired pressure within circuit 44.

Circuit 44 may be provided with a relief passage 72 and a relief valve 74 disposed within relief passage 72. Relief passage 72 may be fluidly connected at an upstream end to rod-end passage 70 and at a downstream end to return passage 60. When a pressure within rod-end passage 70 exceeds a pressure setting of relief valve 74, relief valve 74 may move to allow some fluid from rod-end passage 70 to drain into return passage 60, thereby relieving the pressure within rod-end passage 70. In the disclosed embodiment, the pressure setting of relief valve 74 is variable. It is contemplated, however, that the pressure setting of relief valve 74 may alternatively be fixed, if desired.

Hydraulic control system 42 may also include an energy recovery arrangement 76 configured to selectively recycle waste fluid having an elevated pressure. Energy recovery arrangement 76 may include, among other things, a regeneration passage 78, a blocking valve 80, and a regeneration valve 82. Regeneration passage 78 may extend between head-end passage 66 and rod-end passage 70. Blocking valve 80 may be disposed at an intersection of rod-end passage 70 and regeneration passage 78, and be movable to selectively allow or block fluid flow from rod-end chamber 68 to boom control valve 50. Blocking valve 80 may also fluidly connect rod-end passage 70 to a first end of regeneration passage 78, and selectively allow or block fluid flow from regeneration passage 78 to boom control valve 50. Regeneration valve 82 may selectively allow or block fluid communication between head- and rod-end chambers 64, 68 via head-end and regeneration passages 66 and 78.

Blocking valve 80 may be an electro-hydraulic valve having a logic element 84 and a solenoid element 86 that is hydraulically connected to logic element 84. Logic element 84 may be movable from a first or closed position (shown in FIG. 2) to a second open position when a pressure within rod-end passage 70 exceeds a combined spring bias and control pressure regulated by solenoid element 86. Rod-end chamber 68 may be fluidly connected to regeneration passage 78, but blocked from communication with boom control valve 50. When logic element 84 is in the open position, rod-end chamber 68 and regeneration passage 78 may be fluidly connected with boom control valve 50. Solenoid element 86 may be selectively activated to connect either a pressure of regeneration passage 78 or tank pressure with logic element 84, thereby causing logic element 84 to move between the first and second positions. Logic element 84 may be spring-biased toward the first position. In the disclosed exemplary embodiment, solenoid element 86 may be movable to any position between the first and second position, to thereby vary the position of logic element 84 and a corresponding restriction on a flow of fluid from rod-end chamber 68 to tank 48 via boom control valve 50. It is contemplated, however, that solenoid element 86 could alternatively be a discrete position element, if desired.

Like blocking valve 80, regeneration valve 82 may also be an electro-hydraulic valve and include a spool element 88 and a solenoid element 90 that is hydraulically connected to logic element 84. Spool element 88 may be movable from a first position (shown in FIG. 2) to a second position based on a control pressure regulated by solenoid element 90. When spool element 88 is in the first position, fluid communication between head- and rod-end chambers 64, 68 via head-end, rod-end, and regeneration passages 66, 70, 78 may be inhibited. When spool element 88 is in the second position, head-end chamber 64 may be fluidly connected with rod-end chamber 68. Solenoid element 90 may be selectively activated to connect either tank pressure or pilot pressure with spool element 88, thereby causing spool element 88 to move between the first or second positions. Spool element 88 may be spring-biased toward the first position. In the disclosed exemplary embodiment, solenoid element 90 may be movable to any position between the first and second position, to thereby vary the position of spool element 88 and a corresponding restriction on a flow of fluid between head- and rod-end chambers 64, 68 via regeneration passage 78. It is contemplated, however, that solenoid element 90 could alternatively be a discrete position element, if desired.

A controller 92 may be in communication with the different components of hydraulic control system 42 to regulate operations of machine 10. For example, controller 92 may be in communication with sensors 40, sensor 58, and solenoid elements 86 and 90. Based on various operator input and monitored parameters, as will be described in more detail below, controller 92 may be configured to selectively activate the different valves in a coordinated manner to efficiently carry out operator commands. Controller 92 may include a memory, a secondary storage device, a clock, and one or more processors that cooperate to accomplish a task consistent with the present disclosure. Numerous commercially available microprocessors can be configured to perform the functions of controller 92. It should be appreciated that controller 92 could readily embody a general machine controller capable of controlling numerous other functions of machine 10. Various known circuits may be associated with controller 92, including signal-conditioning circuitry, communication circuitry, and other appropriate circuitry. It should also be appreciated that controller 92 may include one or more of an application-specific integrated circuit (ASIC), a field-programmable gate array (FPGA), a computer system, and a logic circuit configured to allow controller 92 to function in accordance with the present disclosure.

The operational parameters monitored by controller 92, in the exemplary embodiment, may include pressures of fluid associated with energy recovery arrangement 76. For example, one or more pressure sensors 94, 96 may be strategically located in communication with head-end, rod-end, and/or regeneration passages 66, 70, 78 that monitor pressures of the respective passages and generate corresponding signals indicative of the monitored pressures directed to controller 92. It is contemplated that other operational parameters such as, for example, temperatures, viscosities, densities, flow rates, etc. may also or alternatively be monitored and used to regulate operation of hydraulic control system 42, if desired.

INDUSTRIAL APPLICABILITY

The disclosed hydraulic control system may be applicable to any machine that includes multiple fluid actuators where high efficiency is desired. The disclosed hydraulic control system may improve efficiency by selectively recovering energy from the waste fluid of a boom actuator. Operation of hydraulic control system 42 will now be explained.

During operation of machine 10 (referring to FIG. 1), a machine operator may manipulate operator interface devices 38 to cause corresponding movements of work tool 14. The displacement positions of operator interface devices 38 may be related to operator-expected or desired velocities of work tool 14 in particular directions. Operator interface devices 38 may generate hydraulic pilot signals indicative of the operator-expected or desired velocities during manipulation thereof, and send these signals to the appropriate control valves causing pressurized fluid to be directed from pump 46 to the corresponding hydraulic cylinders in the manner desired by the operator.

For example, to raise boom 20, the operator may pull back on interface device 38*a*, thereby generating a corresponding hydraulic lift signal directed to boom control valve 50 that shifts element 62 to the right (relative to FIG. 2). In this position, pressurized fluid from pump 46 may pass through boom control valve 50 and head-end passage 66 to head-end chamber 64 of hydraulic cylinder 24. At this same time, fluid from rod-end chamber 68 may drain through rod-end passage 70, boom control valve 50, and return passage 60 to tank 48. When head-end chamber 64 is filled with pressurized fluid and rod-end chamber 68 is simultaneously drained of pressurized fluid, a pressure differential may be created across the piston assemblies of hydraulic cylinders 24 causing hydraulic cylinders 24 to extend and raise boom 20 (and work tool 14).

In some situations, rather than allowing waste fluid from rod-end chamber 68 to pass into tank 48, it may be more efficient to recycle the fluid by directing the fluid into head-end chamber 64. This situation may occur, for example, during a digging operation of machine 10. The digging operation may be implemented by driving work tool 14 into work surface 22 through extension of hydraulic cylinders 30 and 32. As work tool 14 engages work surface 22, a reactionary force may pass back through boom 20, thereby exerting a lifting force on boom 20. When the operator desires lifting of boom 20 at the same time that boom 20 is being forced upward by the digging action of work tool 14, the waste fluid exiting rod-end chamber 68 may have an elevated pressure that contains significant energy. Controller 92 may recycle this high-pressure fluid by selectively causing blocking valve 80 to block the draining of fluid from rod-end chamber 68 back to tank 48 and instead move regeneration valve 82 to direct the fluid into head-end chamber 64. In particular, controller 92 may activate solenoid element 86, causing solenoid element 86 to connect pressurized fluid with logic element 84, thereby moving logic element 84 to its first position at which fluid flow to boom control valve 50 is blocked. At this same time, controller 92 may activate solenoid element 90, causing solenoid element 90 to connect tank pressure to spool element 88, thereby moving spool element 88 to its second position at which fluid is allowed to flow from rod-end passage 70 through regeneration passage 78 to head-end passage 66 and into head-end chamber 64.

Care should be taken to ensure that conditions are right for fluid regeneration (i.e., for recycling of fluid from rod-end chamber 68 to head-end chamber 64) before moving blocking valve 80 to its flow-blocking position and regeneration valve 82 to its flow-passing position. In particular, if regeneration valve 82 is moved to its flow-passing position when machine 10 is not performing a digging operation and the pressure of rod-end chamber 68 is not greater than the pressure of head-end chamber 64 and/or greater than the pressure of fluid being discharged by pump 46, hydraulic cylinders 24 may actually be caused to extend when retraction is desired. For this reason, controller 92 may first monitor a number of different performance parameters of circuit 44 before attempting regeneration.

For example, controller 92 may first ensure that the digging operation is ongoing before attempting to pass pressurized fluid from rod-end chamber 68 to head-end chamber 64 via energy recovery arrangement 76. And there may be several different ways for controller 92 to ensure that the digging operation is ongoing. In particular, controller 92 could monitor the signals generated by sensor 40 to determine that the operator has moved interface device 38*b* in a manner corresponding with the digging operation (e.g., to determine if the operator has requested an extension of hydraulic cylinder 30 and/or an extension of hydraulic cylinder 32). Alternatively or additionally, controller 92 could monitor fluid pressures and/or flow rates within passages leading to the different chambers of hydraulic cylinders 30, 32 to determine initiation of the digging operation. In the disclosed embodiment, when controller 92 determines that the digging operation is not ongoing, controller 92 may inhibit fluid flow between head- and rod-end chambers 64, 68.

In another example, controller 92 may first ensure that the pressure of fluid within head-end chamber 64 is sufficiently low, indicating that head-end chamber 64 could use the waste fluid being discharged from rod-end chamber 68. Accordingly, controller 92 may monitor the pressure of head-end chamber 64 via sensor 94, and compare the monitored pressure to a first threshold pressure (e.g., to a pressure of fluid discharged from pump 46 and/or from rod-end chamber 68). When the pressure within head-end chamber 64 is above the first threshold pressure, controller 92 may inhibit fluid flow between rod- and head-end chambers 68, 64.

In yet another example, controller 92 may first ensure that the pressure of fluid within rod-end chamber 68 is sufficiently high, indicating that the waste fluid contains significant energy and will flow in the correct direction from rod-end chamber 68 to head-end chamber 64. Accordingly, controller 92 may monitor the pressure of rod-end chamber 68 via sensor 96, and compare the monitored pressure to a second threshold pressure (e.g., to a pressure of fluid discharged from pump 46 and/or within head-end chamber 64). When the pressure within rod-end chamber 68 is below the second threshold pressure, controller 92 may inhibit fluid flow between rod- and head-end chambers 68, 64.

In a final example, controller 92 may first ensure that lifting of boom 20 is desired and/or ongoing, before allowing regeneration. In particular, controller 92 could monitor the signals generated by sensor 40 to determine that the operator has moved interface device 38*a* in a manner corresponding with desired lifting (e.g., to determine if the operator has pulled back on interface device 38*a* to request extension of hydraulic cylinders 24). Alternatively or additionally, controller 92 could monitor fluid pressures and/or flow rates within passages leading to hydraulic cylinders 24 and/or the actual movements of boom 20 or hydraulic cylinders 24 to determine ongoing lifting. In the disclosed embodiment, when controller 92 determines that lifting of boom 20 is not desired and/or ongoing, controller 92 may inhibit fluid flow between head- and rod-end chambers 64, 68.

It is contemplated that more than one of the conditions described above may be simultaneously detected/determined by controller 92 before initiating regeneration. Specifically, controller 92 may be configured to allow regeneration during lifting of boom 20 only when the digging operation is determined to be ongoing and when the pressures within head- and rod-end chambers 64, 68 are below and above the first and second thresholds, respectively.

During regeneration of fluid within hydraulic cylinder 24, from rod-end chamber 68 to head-end chamber 64, supplemental fluid may be required from pump 46. In particular, because of relative pressure areas within head- and rod-end chambers 64, 68, the flow rate of fluid exiting rod-end chamber 68 may be less than the flow rate of fluid being consumed by head-end chamber 64. Accordingly, during lifting of boom 20, some amount of pressurized fluid from pump 46 may pass through boom control valve 50 to join the recycled fluid from rod-end chamber 68 entering head-end chamber 64.

To lower boom 20, the operator may push forward on interface device 38*a*, thereby generating a corresponding hydraulic lower signal directed to boom control valve 50 that shifts element 62 to the left (relative to FIG. 2). In this position, pressurized fluid from pump 46 may pass through boom control valve 50 and rod-end passage 70 into rod-end chamber 68 of hydraulic cylinder 24. At this same time, fluid from head-end chamber 64 may drain through head-end passage 66, boom control valve 50, and return passage 60 to tank 48. When rod-end chamber 68 is filled with pressurized fluid and head-end chamber 64 is simultaneously drained of pressurized fluid, a pressure differential may be created across the piston assemblies of hydraulic cylinders 24 causing hydraulic cylinders 24 to retract and lower boom 20.

Regeneration of fluid within hydraulic cylinder 24 may also be possible during lowering of boom 20. In particular, the weight of boom 20 and work tool 14, combined with any load on work tool 14, may generate a retracting force on hydraulic cylinder 24. When the operator desires lowering of boom 20 under this retracting force, the waste fluid exiting head-end chamber 64 may have an elevated pressure that contains significant energy. Controller 92 may recycle this high-pressure fluid by selectively causing blocking valve 80 to block the return of waste fluid from head-end chamber 64 back to tank 48 via rod-end passage 70 and simultaneously move regeneration valve 82 to allow the pressurized fluid into rod-end chamber 68. In particular, controller 92 may activate solenoid element 86, causing solenoid element 86 to connect pressurized pilot fluid with logic element 84, thereby moving logic element 84 to its first position at which fluid flow to boom control valve 50 is blocked. At this same time, controller 92 may activate solenoid element 90, causing solenoid element 90 to connect tank pressure to spool element 88, thereby moving spool element 88 to its second position at which fluid is allowed to flow from rod-end passage 70 through regeneration passage 78 to head-end passage 66 and into head-end chamber 64. Unlike regeneration during extension of hydraulic cylinders 24, regeneration during retraction may be accomplished regardless of operations being performed by other actuators (i.e., regardless of initiation of the digging operation), although pressures of head- and rod-end chambers 64, 68 may still be monitored and used to affect movement of blocking and regeneration valves 80, 82, if desired.

During regeneration of fluid within hydraulic cylinder 24, from head-end chamber 64 to rod-end chamber 68, surplus fluid may be discharged from head-end chamber 64. In particular, because of relative pressure areas within head- and rod-end chambers 64, 68, the flow rate of fluid exiting head-end chamber 64 may be greater than the flow rate of fluid required within rod-end chamber 68. Accordingly, during lowering of boom 20, some fluid from head-end chamber 64 may pass through boom control valve 50 to tank 48 via return passage 60. The restriction on this flow of fluid within spool element 62 may help ensure that an adequate amount of the pressurized fluid from head-end passage 66 is directed into rod-end passage 68.

The disclosed hydraulic system may be easily retrofitted to existing pilot-controlled machines. In particular, because the disclosed hydraulic system may rely on pilot-operated valves to control one or more fluid functions of an associated actuator (i.e., draining and/or filling functions), few component changes may be required when retrofitting the system to a pilot-controlled machine. In addition, the disclosed hydraulic system, because it may consider critical performance factors during regeneration, may have improved reliability and control.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system for a machine, comprising:
- a pump;
- a tank;
- an actuator having a first chamber and a second chamber;
- at least a first valve configured to control fluid flow between the pump, the tank, the first chamber of the actuator, and the second chamber of the actuator;
- a second valve fluidly disposed between the second chamber of the actuator and the tank;
- a third valve fluidly disposed between the first and second chambers of the actuator; and
- a controller in communication with the second and third valves, wherein the controller is configured to:
  - selectively cause the second valve to block fluid flow from the second chamber of the actuator to the tank; and
  - selectively cause the third valve to fluidly communicate the first and second chambers of the actuator when the second valve blocks fluid flow from the second chamber of the actuator to the tank.

2. The hydraulic control system of claim 1, wherein:

the actuator is a first actuator;

the hydraulic control system further includes:

a second actuator; and a sensor configured to detect an operation performed by the second actuator; and the controller is in further communication with the sensor and configured to cause the second valve to block fluid flow from the second chamber of the actuator to the tank only when the sensor detects the operation.

3. The hydraulic control system of claim 2, wherein:

the second actuator is configured to move at least one of a stick and a bucket of the machine; and the operation is a digging operation that generates an extending force on the first actuator.

4. The hydraulic control system of claim 2, wherein:

the sensor is a first sensor;

the hydraulic control system includes a second sensor configured to detect a pressure of the first chamber of the actuator; and the controller is in further communication with the second sensor and configured to cause the second valve to block fluid flow from the second chamber of the actuator to the tank only when the pressure of the first chamber is below a threshold pressure.

5. The hydraulic control system of claim 4, further including a third sensor configured to detect a pressure of the second chamber of the actuator, wherein the controller is in further communication with the third sensor and configured to cause the second valve to block fluid flow from the second chamber to the tank only when the pressure of the second chamber is greater than a threshold pressure.

6. The hydraulic control system of claim 2, wherein:

the sensor is a first sensor;

the hydraulic control system includes a second sensor configured to detect movement associated with the first actuator; and the controller is in further communication with the second sensor and configured to cause the second valve to block fluid flow from the second chamber of the actuator to the tank only when the movement corresponds with extension of the first actuator.

7. The hydraulic control system of claim 1, wherein the at least a first valve includes a single pilot-operated spool valve.

8. The hydraulic control system of claim 1, wherein fluid is passed fluid from the second chamber of the actuator to the third valve when fluid flow from the second chamber of the actuator to the tank is blocked.

9. The hydraulic control system of claim 1, wherein the controller is further configured to move the at least a first valve to direct a supplemental flow of pressurized fluid from the pump to the first chamber of the actuator when the third valve fluidly connects the first and second chamber of the actuator.

10. The hydraulic control system of claim 9, wherein the controller is configured to:

cause the second valve to block fluid flow from the second chamber of the actuator to the tank and cause the third valve to fluidly communicate the first and second chambers of the actuator only during an extending operation of the actuator; and maintain fluid flow from the first chamber of the actuator to the tank and cause the third valve to fluidly communicate the first and second chambers of the actuator during a retracting operation of the actuator.

11. The hydraulic control system of claim 10, wherein:

the at least a first valve is disposed between the second valve and the tank; and the second valve is configured to block fluid flow from the second chamber of the actuator to the at least a first valve when fluid flow from the second chamber of the actuator to the tank is blocked by the second valve.

12. The hydraulic control system of claim 10, wherein the controller is configured to maintain fluid flow from the first chamber of the actuator to the tank and cause the third valve to fluidly communicate the first and second chambers of the actuator during a retracting operation of the actuator based on a sensed pressure of fluid within the first chamber of the actuator and based on an operator request to move the actuator.

13. The hydraulic control system of claim 12, wherein:

the actuator is a first actuator; and the controller is configured to maintain fluid flow from the first chamber of the actuator to the tank and cause the third valve to fluidly communicate the first and second chambers of the actuator during a retracting operation of the first actuator regardless of actuation of other actuators.

14. A method of recovering energy for a machine, comprising:

pressurizing fluid with a pump;

selectively moving at least a first control valve to direct pressurized fluid from the pump to first or second chambers of a first actuator and from the second or first chambers of the first actuator to a tank to move the first actuator;

selectively blocking fluid flow from the second chamber of the first actuator to the tank; and selectively fluidly communicating the first chamber of the first actuator with the second chamber of the first actuator when the fluid flow from the second chamber of the first actuator to the tank is blocked.

15. The method of claim 14, further including detecting a digging operation performed by a second actuator that generates an extending force on the first actuator, wherein selectively blocking fluid flow from the second chamber of the first actuator to the tank includes blocking fluid flow from the second chamber of the first actuator to the tank only when the digging operation is detected.

16. The method of claim 15, further including detecting a pressure of the first chamber of the first actuator, wherein selectively blocking fluid flow from the second chamber of the first actuator to the tank includes blocking fluid flow from the second chamber of the first actuator to the tank only when the pressure of the first chamber of the first actuator is below a threshold pressure.

17. The method of claim 14, wherein:

wherein selectively blocking fluid flow from the second chamber of the first actuator to the tank includes blocking fluid flow from the second chamber of the first actuator to the tank only during an extending operation of the first actuator; and the method further includes maintaining fluid flow from the first chamber of the first actuator to the tank and selectively fluidly communicating the first and second chambers of the first actuator during a retracting operation of the first actuator while fluid flow from the first chamber of the first actuator to the tank is maintained.

18. A hydraulic control system for a machine, comprising:

a pump;

a tank;

an actuator having a first chamber and a second chamber, and a piston separating the first and second chambers, the piston movable in an extending direction and in a retracting direction;

a first valve configured to control fluid flow between the pump, the tank, the first chamber of the actuator, and the second chamber of the actuator;

a second valve fluidly disposed between the second chamber of the actuator and each of the first valve and the first chamber; and a third valve fluidly disposed between the first chamber and the second valve, wherein when the piston is moving in the extending direction, the second valve is configured to selectively block fluid flow from the second chamber to the tank; and the first valve is configured to direct pressurized fluid from the pump to combine with pressurized fluid from the second chamber entering the first chamber.

19. The hydraulic control system of claim 18, further including a controller in communication with the second and third valves, the controller being configured to:

selectively cause the second valve to block fluid flow from the second chamber of the actuator to the tank; and selectively cause the third valve to fluidly communicate the first and second chambers of the actuator when the second valve blocks fluid flow from the second chamber of the actuator to the tank.

20. The hydraulic control system of claim 19, wherein:

the actuator is a first actuator;

the hydraulic control system further includes:

a second actuator; and a sensor configured to detect an operation performed by the second actuator; and the controller is in further communication with the sensor and configured to cause the second valve to block fluid flow from the second chamber of the actuator to the tank only when the sensor detects the operation.

* * * * *